US005731274A

United States Patent [19]

Andrew

[11] Patent Number: 5,731,274

[45] Date of Patent: Mar. 24, 1998

[54] LITHIUM COMPLEX GREASE WITH EXTENDED LUBRICATION LIFE

[75] Inventor: David Leslie Andrew, Strathroy, Canada

[73] Assignee: Exxon Research and Engineering Company, Florham Park, N.J.

[21] Appl. No.: 712,066

[22] Filed: Sep. 11, 1996

[51] Int. Cl.[6] ..... C10M 123/02

[52] U.S. Cl. ..... 508/272; 508/521

[58] Field of Search ..... 508/272, 521

[56] References Cited

U.S. PATENT DOCUMENTS

| | | | |
|---|---|---|---|
| 3,929,651 | 12/1975 | Murray et al. | 508/512 |
| 3,940,339 | 2/1976 | Clark, Jr. et al. | 508/158 |
| 4,176,075 | 11/1979 | Alexander et al. | 508/511 |
| 4,849,118 | 7/1989 | Stauffer et al. | 508/273 |
| 4,935,157 | 6/1990 | Karol | 508/272 |
| 5,368,758 | 11/1994 | Gapinski | 508/273 |
| 5,462,682 | 10/1995 | Delfort et al. | 508/274 |
| 5,490,946 | 2/1996 | Beltzer et al. | 508/273 |

*Primary Examiner*—Jacqueline V. Howard
*Attorney, Agent, or Firm*—Joseph J. Allocca

[57] ABSTRACT

A lithium complex grease of extended lubricating life and possessing enhanced high temperature antioxidancy comprises a major portion of a base oil stock of lubricating viscosity and a minor mount of a lithium complex soap thickener, dilithium salicylate and a thiadiazole.

19 Claims, No Drawings

LITHIUM COMPLEX GREASE WITH EXTENDED LUBRICATION LIFE

BACKGROUND OF THE INVENTION

1. Field of the Invention

The present invention relates to a complex lithium soap thickened greases having extended lubricating life, and enhanced high temperature anti-oxidancy which are not degraded by the presence of water resistance, extreme pressure or other performance enhancing additives.

2. Description of the Related Art

Lithium complex soap greases have been known and manufactured for quite some time. Such greases can be made from any of a wide number of different base stocks of lubricating oil viscosity, and combination and mixtures of such stocks. The resulting greases are all marked by varying levels of desirable grease characteristics including dropping point, mechanical and/or shear stability, oxidation resistance, etc., all of which in combination are taken into account of description the lubricating life of the grease.

Lubricating formulations and greases containing a wide assortment of different materials are described in the literature.

Japanese applications JP 63162791 discloses grease compositions containing 5,5'dithio bis (1,3,4-thiadiazole-2-thiol) and an amine anti-oxidant such as alkylated diphenyl amine or a phenol anti-oxidant in addition to a lithium soap or composite complex lithium soap. The grease is described as having a life time two to eight times longer at high temperatures (130° to 150° C.) than a corresponding comparison grease. The longest lived formulation in the application was a complex lithium soap grease containing Vanlube 829 and a phenol anti-oxidant.

U.S. Pat. No. 5,462,682 is directed to a colloidal product containing calcium and/or magnesium as well as sulfur and nitrogen prepared by modifying colloidal products comprising overbasic sulfonate and/or overbasic phenate and/or overbasic salicylate charged with calcium carbonate and/or magnesium carbonate in the form of micelles by the partial neutralization of the micelles by means of at least one dicarboxylic acid of the formula

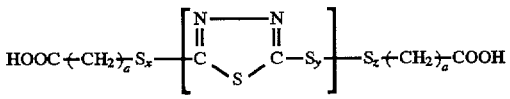

wherein "a" is a whole number of 1 to 8, "x" and "z" are whole numbers ranging from 0 to 4, "n" is 1 or 2, and "y" is a whole number ranging from 0 to 4. The material is useful in lube oils and greases as an anti wear and extreme pressure additive.

U.S. Pat. No. 4,849,118 describes a lubricant comprising a base oil and a minor amount of a 1,3,4-thiadiazole, an overbased detergent selected from alkali and alkaline earth metal sulfonates, phenates and salicylates, and an ashless dispersant.

U.S. Pat. No. 3,985,662 describes a grease comprising a base oil of lubricating viscosity and a lithium soap derived from a fatty acid containing an epoxy group and/or ethylenic unsaturation and a dilithium salt derived from a straight chain dicarboxylic acid and, preferably a lithium salt derived from a hydroxy-substituted carboxylic acid such as salicylic acid. The patent recites that grease properties are generally improved when the grease contains a hydroxy substituted aromatic acid component, i.e., lithium salt of methyl salicylate.

U.S. Pat. No. 3,940,339 describes a lubricating grease containing a base oil and a combination of lithium complex grease thickener, a quaternary ammonium nitrate and an amino imidazoline. The thickener is a complex of a lithium soap of a $C_{12}$ to $C_{24}$ hydroxy fatty acid and a monolithium salt of boric acid and can include a lithium salt of a second hydroxy carboxylic acid such as salicylic acid.

U.S. Pat. No. 4,176,075 describes a high temperature grease with excellent oxidation stability comprising a base oil of lubricating viscosity, a lithium soap of a $C_{12}$ to $C_{24}$ hydroxy fatty acid thickener antioxidant comprising an alkali metal salt of hydroxy benzoic acid and a diozime compound. The alkali metal salt of hydroxy benzoic acid include dilithium salicylate.

U.S. Pat. No. 3,929,651 describes a grease of excellent oxidation stability prepared using a complex lithium soap which is a combination of a dilithium salt of a $C_4$–$C_{12}$ dicarboxylic acid, e.g., dilithium azelate, a lithium soap of a 9-, 10- or 12-hydroxy $C_{12}$–$C_{24}$ fatty acid, e.g., lithium 12-hydroxy stearate; and a lithium salt formed in-situ in the grease from a second hydroxy carboxylic acid wherein the —OH group is attached to a carbon atom not more than 6 carbons removed from the carboxyl group and wherein either of those groups may be attached to either aliphatic or aromatic portions of the materials. Sufficient lithium hydroxide can be used to form the dilithium salt of the latter acid, e.g., dilithium salicylate.

DESCRIPTION OF THE INVENTION

The present invention is directed to a complex lithium soap grease of enhanced high temperature oxidation stability and long lubricating life comprising a major mount of a base stock off of lubricating viscosity and a minor mount of a complex lithium soap thickener, a lithium salt of a $C_3$–$C_{14}$ hydroxycarboxylic acid and a thiadiazole. The grease may also optionally and preferably contain additional antioxidants, preferably amine type or phenol type antioxidants, most preferably amine type antioxidants.

In the present grease, the base stock is a base oil of lubricating viscosity.

The lubricating oil base stock that is used in preparing the grease compositions of this invention can be any of the conventionally used mineral oils, synthetic hydrocarbon oils or synthetic ester oils. In general, these lubricating oils will have a viscosity in the range of about 20 to 500 SUS at 210° F. Minerals lubricating oil base stocks used in preparing the greases can be any conventionally refined base stocks derived from paraffinic, naphthenic and mixed base crudes. Synthetic lubricating oils that can be used include esters of di-basic acids, reacted with linear or branched aliphatic alcohols such as $C_6$–$C_{15}$ alcohols, such as di-2-ethylhexyl sebacate, esters of glycols such as $C_{13}$ oxo acid diester or tetraethylene glycol, or complex esters such as one formed from 1 mole of sebacic acid and 2 moles of tetraethylene glycol and 2 moles of 2-ethylhexanoic acid. Other synthetic oils that can be used include synthetic hydrocarbons such as alkyl benzenes, e.g., alkylate bottoms from the alkylation of benzene with tetrpropylene, or the copolymers of ethylene and propylene; silicone oils, e.g., ethyl phenyl polysiloxanes, methyl polysiloxanes, etc.; polyglycol oils, e.g., those obtained by condensing butyl alcohol with propylene oxide; carbonate esters, e.g., the product of reacting $C_6$ oxo alcohol with ethyl carbonate to form a half ester followed by reaction of the latter with tetraethylene glycol, etc. Other suitable synthetic oils include the polyphenyl ethers, e.g., those having from about 3 to 7 ether linkages and about 4 to 8 phenyl groups. (See U.S. Pat. No. 3,424,686, column 3.)

Other suitable oils are the polyol ester oils made by reacting an aliphatic polyol with carboxylic acid. Aliphatic polyols contain from 4 to 15 carbon atoms and has from 2 to 8 esterifiable hydorxyl groups. Examples of polyols are trimethylolpropane, pentaerythritol, dipentaerythritol, neopentyl glycol, tripentaeythritol and mixtures thereof. The carboxylic acid reactant is selected from aliphatic monocarboxylic acid or mixtures of aliphatic mono carboxylic acids or mixtures of aliphatic mono- and di-carboxylic acids. The carboxylic acids contain 4 to 12 carbons and include straight and branched chain carboxylic acids.

The grease contains a minor amount of complex lithium soap, an additional lithium salt of a hydroxy carboxylic acid and a thiadiazole. Amine type or phenol type anti-oxidants may also be included.

The complex lithium soap thickeners typically comprise a combination of a dilithium salt of a $C_2$–$C_{12}$ dicarboxylic acid, or mono- or di-esters of such acids and a lithium salt of a $C_{12}$ to $C_{24}$ fatty acid or of a 9-, 10-, or 12- hydroxy $C_{12}$–$C_{24}$ fatty acid or the esters of such acids. The hydroxy fatty acid or esters thereof employed in preparing the greases of this invention will have from about 12 to 24, or more usually about 16 to 20 carbon atoms, and will preferably be a hydroxystearic acid or ester, e.g., 9-hydroxy, 10-hydroxy, or 12-hydroxystearic acid, or ester, more preferably the 12-hydroxystearic acid or ester thereof. Ricinoleic acid or ester thereof, which is an unsaturated form of 12-hydroxystearic acid, having a double bond in the 9–10 position, can also be used. Other hydroxy fatty acids include 12-hydroxybehenic acid and 10-hydroxypalmitic acid.

The $C_2$–$C_{12}$ dicarboxylic acid employed in preparing the lithium soaps used to thicken the greases of the present invention will be one or more straight or branched chain $C_2$–$C_{12}$ dicarboxylic acids, preferably a $C_4$ to C12 more preferably a $C_6$ to $C_{10}$ dicarboxylic acid or the mono- or di-esters of the acids. Such materials include oxalic, malonic, succinic, glutaric, adipic, suberic, pimelic, azelaic, dodecanedioic and sebacic acids or the mono- or di-esters thereof. Sebacic and azelaic acids are particularly preferred and may be used either individually or as a mixture, preferably individually.

The additional lithium salt component, the lithium salt of the hydroxy carboxylic acid used in this invention, is derived from one or more hydroxy carboxylic acids or esters thereof having an OH group attached to a carbon atom that is not more than 6 carbon atoms removed from the carbon of the carboxyl group. This second hydroxy acid has from 3 to 14 carbon atoms and can be either an aliphatic acid such as lactic acid, 6-hydroxydecanoic acid, 3-hydroxybutanoic acid, 4-hydroxybutanoic acid, 6-hydroxy-alpha-hydroxystearic acid, etc., or an aromatic acid such as para-hydroxy-benzoic acid, salicylic acid, 2-hydroxy-4-hexylbenzoic acid, meta-hydroxybenzoic acid, 2,5-dihydroxybenzoic acid (gentisic acid); 2,6-dihydroxybenzoic acid (gamma resorcyclic acid); 2-hydroxy-4-methoxybenzoic acid, etc., or a hydroxyaromatic aliphatic acid such as 2-(ortho hydroxyphenyl), 2-(meta hydroxyphenyl), or 2-(parahydroxyphenyl) ethanoic acid. A cycloaliphatic hydroxy acid such as hydroxycyclopentyl carboxylic acid or hydroxynaphthenic acid could also be used. Particularly useful hydroxy acids (or the esters thereof) are 2-hydroxy-4-methoxybenzoic acid, salicylic acid, and parahydroxybenzoic acid. Instead of using the free hydroxy acid of the latter type when preparing the grease, one can use a lower alcohol ester, e.g., the methyl, ethyl, or propyl, isopropyl, or sec-butyl ester of the acid, e.g., methyl salicylate. The ester of the hydroxy carboxylic acid is hydrolyzed with aqueous lithium hydroxoide to give the lithium salt. The monolithium salt or the dilithium salt of this $C_3$–$C_{14}$ hydroxy acid or ester thereof can be used, but the dilithium salt is preferred.

The three component lithium soap thickener system comprising the lithium soap of a $C_{12}$ to $C_{24}$ hydroxy fatty acid or ester, the dilithium soap of a $C_2$ to $C_{12}$ dicarboxylic acid or ester and the lithium salt of a $C_3$–$C_{14}$ hydroxy carboxylic acid or ester thereof as hereinbefore defined employed in the present invention is disclosed and claimed in U.S. Pat. No. 3,929,651, which also recites the process for producing a grease containing the three component soap thickener, the teachings of which are incorporated herein by reference.

The three component soap thickener used to produce the grease of the present invention can be formed in a number of different ways. One convenient way when the $C_3$–$C_{14}$ hydroxy carboxylic acid is salicylic acid is to co-neutralize the $C_{12}$–$C_{24}$ fatty acid or 9-, 10-, or 12- hydroxy $C_{12}$–$C_{24}$ fatty acid and the dicarboxylic acid in at least a portion of the oil with lithium hydroxide. This neutralization will take place at a temperature in the range of about 180° F. to 220° F. When the soap stock has thickened to a heavy consistency, the temperature is raised to about 260° F. to 300° F., to bring about dehydration. The soap stock is then cooled to about 190° F. to 210° F., and the additional acid or ester of the $C_3$–$C_{14}$ hydroxy carboxylic acid, e.g., methyl salicylate is added; then, additional lithium hydroxide is added gradually to convert the salicylate to the dilithium salicylate salt. Reaction is conducted at about 220° F. to 240° F., preferably with agitation so as to facilitate the reaction. In this reaction, the alcohol is evolved, and dilithium salicylate forms.

Dehydration is then completed at 300° F. to 320° F., after which the grease is heated at 380°–390° F. for 15 minutes to improve its yield and is then cooled while additional oil is added to obtain the desired consistency. Alternatively, the additional oil can be added to the soap concentrate prior to the in situ formation of the dilithium salicylate.

An alternative method is to co-neutralize all three types of acid used in making the grease, or to saponify a lower ester of the hydroxy acid, e.g., methyl salicylate, simultaneously with the neutralization of the hydroxy acid of the first type, e.g., hydroxystearic acid and the dicarboxylic acid. Still another alternative is to co-neutralize the hydroxy fatty acid and the ester of the hydroxy acid followed by neutralization of the dicarboxylic acid.

The greases of the present invention contain, based on the finished grease mass, from about 2 to about 35 wt % and preferably about 10 to about 25 wt % of all three lithium salt components. The additional lithium salt of the $C_3$–$C_{14}$ hydroxycarboxylic acid (e.g., dilithium salicylate) is present in the grease in an mount in the range 0.05 to 10 wt % of the finished grease. The proportion of the lithium soap of $C_{12}$–$C_{24}$ fatty acid or 9-, 10- or 12- hydroxy $C_{12}$–$C_{24}$ fatty acid to the lithium soap of the dicarboxylic acid can be in the range of 0.5 to 15 parts by weight of the former to one part by weight of the latter, and preferably in the range of 1.5 to 5 parts by weight of the soap of the $C_{12}$–$C_{24}$ fatty acid or 9-, 10- or 12- hydroxy $C_{12}$–$C_{24}$ fatty acid to one part by weight of the soap of the dicarboxylic acid. The proportion of the $C_3$–$C_{14}$ hydroxy carboxylic acid to the dicarboxylic acid will be from about 0.025 to 2.5 parts by weight of the hydroxy carboxylic acid to one part by weight of the dicarboxylic acid, preferably about 0.125 to 1.25 parts by weight of the hydroxy carboxylic acid to one part by weight of the dicarboxylic acid.

The grease of the present invention also contains as a necessary component a thiadiazole.

The thiadiazole type materials are of the general formula (1)

$$R_1—(S)_x—Q—(S)_y—R_2 \quad (1)$$

wherein Q is a 1,3,4-thiadiazole, 1,2,4-thiadiazole, 1,2,3-thiadiazole or a 1,2,5-thiadiazole heterocycle, "x" and "y" may be the same or different and are integers from 1 to 5 and $R_1$ and $R_2$ are the same or different and are H or $C_1$–$C_{50}$ hydrocarbyl, or (2)

$$R_1—(S)_x—Q_1—(S)_z—Q_2—(S)_y—R_2 \quad (2)$$

wherein $Q_1$ and $Q_2$ are the same or different and are 1,3,4-thiadiazole, 1,2,4-thiadiazole, 1,2,3-thiadiazole or 1,2,5-thiadiazole heterocycles, "x", "y", and "z" may be the same or different and are integers of from 1 to 5, and $R_1$ and $R_2$ are the same or different and are H or $C_1$–$C_{50}$ hydrocarbyl. The preferred thiadiazole has the structure 2 where x=1, y=1 and z=2, $R_1$=hydrogen, $R_2$=hydrogen and $Q_1$=$Q_2$ and is 1,3,4-thiadiazole. The preferred thiadiazole is available from R. T. Vanderbilt Company, Inc., under the tradename Vanlube 829.

The thiadiazole material is present in the grease in an amount in the range 0.05 to 5 wt % of the finished grease.

Additional antioxidants may be present, preferred antioxidants being selected from the group consisting of amine type antioxidants, phenolic type antioxidants and mixtures thereof the most preferred antioxidants being amine type antioxidants. The additional antioxidants will provide additional anti-oxidant protection to the grease formulations comprising the base stock, thiadizole and complex lithium soap compounds in much the same way that they provide anti oxidant protection to conventional complex lithium soap greases which do not contain thiadiazole and the lithium soap of the second hydroxyl carboxylic acid.

The amine type anti-oxidants include diarylamines and thiodiaryl amines. Suitable diarylamines include diphenyl amine; phenyl-α-naphthylamine; phenyl-β-naphthylamine; α-α-di-naphthylamine; β-β-dinaphthylamine; or α,β-dinaphthylamine. Also suitable antioxidants are diarylamines wherein one or both of the aryl groups are alkylated, e.g., with linear or branched alkyl groups containing 1 to 12 carbon atoms, such as the diethyl diphenylamines; dioctyldiphenyl amines, methyl phenyl-α-naphthylamines; phenyl-β(butyl-naphthyl) amine; di(4-methyl phenyl) amine or phenyl (3-propyl phenyl) amine octyl-butyl-diphenylamine, dioctyldiphenyl amine, octyl-, nonyl-diphenyl amine, dinonyl di phenyl amine and mixtures thereof.

Suitable thiodiarylamines include phenothiazine, the alkylated phenothiazines, phenyl thio-α-naphthyl amine; phenyl thio-β-naphthylamine; α-α-thio dinaphthylamine; β-β-thio dinaphthylamine; phenyl thio-α(methyl naphthyl) amine; thio-di (ethyl phenyl) amine; (butyl phenyl) thio phenyl amine.

Other suitable antioxidants include s-triazines of the formula

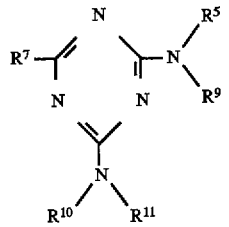

where $R^8$, $R^9$, $R^{10}$, $R^{11}$, are hydrogen, $C_1$ to $C_{20}$ hydrocarbyl or pyridyl, and $R^7$ is $C_1$ to $C_8$ hydrocarbyl, $C_1$ to $C_{20}$ hydrocarbylamine, pyridyl or pyridylamine. If desired mixtures of antioxidants may be present in the lubricant composition of the invention.

Phenolic type anti-oxidants include 2,6-di-t-butyl phenol, 2,6-di-t-butyl alkylated phenol where the alkyl substituent is hydrocarbyl and contains between 1 and 20 carbon atoms, such as 2,6-di-t-butyl-4-methyl phenol, 2,6-di-t-butyl-4-ethyl phenol, etc., or 2,6-di-t-butyl-4-alkoxy phenol where the alkoxy substituent contains between 1 and 20 carbons such as 2,6-di-t-butyl-4-methoxyphenol; mateirals of the formula

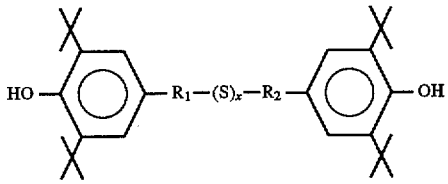

where X is zero to 5, $R_1$ and $R_2$ are the same or different and are $C_1$–$C_{20}$ hydrocarbyl which may contain oxygen or sulfur or be substituted with oxygen or sulfur containing groups; and materials of the formula

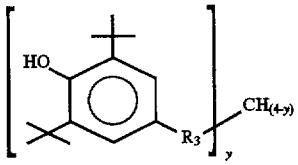

where y is 1 to 4 and $R_3$ is a $C_1$ to $C_{20}$ hydrocarbyl which may contain oxygen or sulfur or be substituted with oxygen or sulfur containing groups, and mixtures of such phenolic type antioxidants.

If present at all the additional, optional antioxidants, preferably amine type and/or phenolic antioxidants are present in the grease in an amount up to 5 wt % of the finished grease.

The amount of lithium salt of the second hydroxy carboxylic acid, and thiadiazole present in the grease in total is in the range 0.1 to 15 wt % of the finished grease.

It has been discovered that lithium complex greases can have the lubricating life greatly extended and exhibit enhanced high temperature oxidation resistance by including in the formulation a combination of a lithium salt of a hydroxy carboxylic acid, such as dilithium salicylate, and a thiadiazole, such as 5,5'-dithiobis (1,3,4-thiadiazole-2-thiol). Greases from which one of the above two recited ingredients is omitted do not exhibit oxidation resistance to the same degree as do greases in which both components are present.

The greases of the present invention may, of course, contain any of the other, typical grease additives such as rest inhibitors, barium dinonyl naphtheline sulfonate, order modifiers, tackiness agents, extreme pressure agents, water shedding agents, dyes, etc. Typical additives and their function are described in Modem Lubricating Greases by C. J. Boner, Scientific Publication (G.B.) Ltd. 1976.

The present invention is demonstrated in the following non-limiting examples and comparative examples.

EXAMPLES

In the following Examples, the lubrication life in hours was determined by ASTM method D3336 at a test temperature of 177° C. (350° F.). For each grease formulation, 5 independent bearing failure points were determined using equipment conforming to the ASTM D3336 specification. Weibull statistics were then used to determine the L(50) failure point for the statistical data set. The L(50) valve is reproved as the grease lubrication life for all grease formulations listed.

EXAMPLE 1

Grease compositions 1 and 3 in Table 1 contain 5,5'-dithiobis-(1,3,4-thiadiazole-2,2'-disulfide) (i.e., Vanlube 829) and dilithium salicylate, respectively. Grease composition 5 contains both of these components in the same formulation. The fact that the ASTM D3336 lubrication life of Grease 5 is significantly longer than the lubrication life of either Grease 1 or Grease 3 indicates that a significant beneficial effect is achieved by combining the two components in the same formulation. A synergistic interaction between the two components can be demonstrated by comparing the lubrication lives of Grease compositions 2 and 4 with the lubrication life of Grease 5. The results obtained for Greases 2 and 4 indicate that the lubrication life of a grease cannot be increased by simply raising the concentration of either the Vanlube 829 or the dilithium salicylate in formulations containing just one of these components. In fact, comparison of the lubrication life of Grease 2 with the lubrication life of Grease 1 demonstrates that there may be debits to increasing the concentration of dilithium salicylate passed a certain point. Similarly, a comparison of the lubrication lives of Greases 3 and 4 demonstrates that increasing the Vanlube 829 concentration may also have debits. Therefore, the data show that the excellent lubrication life obtained for Grease 5 is a result of a novel interaction between the thiadiazole (e.g., Vanlube 829) and the di-lithium salt of the hydroxy carboxylic acid (e.g., dilithium salicylate) which increases the effective antioxidant characteristics of the formulation. The lubrication life exhibited by Grease 5 cannot be achieved by utilizing Vanlube 829 or dilithium salicylate independently.

The data in Table 1 are not intended to demonstrate the effect of dialkylated diphenylamine antioxidant. This particular component is part of the antioxidant package and does contribute to increased grease life; however, the significant improvement in lubrication life of Grease 5 relative to the lubrication lives of Greases 1 to 4 is a result of the thiadiazole plus lithium salt of $C_3$–$C_4$ hydroxy carboxylic acid synergy and not a result of the presence of the dialkylated diphenylamine. The concentration of the dialkylated diphenylamine antioxidant was kept constant for Greases 1 to 5; therefore, the contribution of this antioxidant to grease life was also kept constant. The differences between the lubrication life of Grease 5 and the lubrication lives of the other greases are the result of the thiadiazol plus lithium salt of $C_3$–$C_{14}$ hydroxy carboxylic acid interaction and not the dialkylated diphenylamine antioxidant.

Japanese application J6 3162791 (referenced above) is directed toward lubricant compositions containing Vanlube 829 and aminic or phenolic based antioxidants. The applicants in that case claim that those grease compositions have lubrication lives 2 to 8 times longer than conventional lithium or lithium complex greases. This Japanese patent application does not discuss greases which contain lithium salts of $C_3$–$C_{14}$ hydroxycarboxylic acids. Greases 3 and 4 are essentially the same types of formulations as those listed in the Japanese application. A comparison of Grease 3 or 4 with Grease 5 demonstrates that a significant improvement in grease life is achieved when the lithium salt of a $C_3$–$C_{14}$ hydroxy carboxylic acid e.g.) dilithium salicylate is added to formulations containing Vanlube 829 and an amine based antioxidant. These improvements are the direct result of interactions between Vanlube 829 and the lithium salt of a $C_3$–$C_{14}$ hydroxy carboxylic acid (e.g., dilithium salicylate) and not a result of interactions between Vanlube 829 and an amine such as those proposed in the Japanese patent application.

TABLE 1

| | Grease 1 in wt % | Grease 2 in wt % | Grease 3 in wt % | Grease 4 in wt % | Present Invention Grease 5 in wt % |
|---|---|---|---|---|---|
| COMPONENT | | | | | |
| Lithium Complex Soap Components and Mineral Base Oils | 92.8 | 92.1 | 93.8 | 92.9 | 92.2 |
| Dialkylate Diphenylamine Antioxidant | 1.5 | 1.4 | 1.5 | 1.4 | 1.4 |
| Dilithium Salicylate | 2.5 | 3.4 | 0 | 0 | 2.1 |
| 5,5'-dithiobis-(1,3,4-thiadiazole-2,2'-disulfide), i.e., Vanlube 829 | 0 | 0 | 1.0 | 2.0 | 1.0 |
| EP, antiwear and other additives | 3.2 | 3.1 | 3.7 | 3.7 | 3.3 |
| TESTS | | | | | |
| NLGI Grease Grade | 2 | 2 | 2 | 2 | 2 |
| ASTM D3336 Lubrication Life @ 177° C. L (50) in hours for 5 tests: | 340 | 295 | 264 | 189 | 691 |

EXAMPLE 2

The grease of the present invention (Grease 5 of Table 1) was compared against a number of different commercial multi purpose or long life greases of varying formulations. The results are presented below in Table 2.

TABLE 2

| | Thickener Type | Base Oil Type | ASTM D3336 Performance L (50) in hours at 177° C. | Commercial Description |
|---|---|---|---|---|
| Commercial Grease 1 | lithium complex | mineral oil | <150 (typical) | NLGI 2 grade, multi-purpose automotive grease |
| Commercial Grease 2 | lithium complex | PAO synthetic hydrocarbon | 298 | NLGI 1.5 grade, premium synthetic industrial grease |
| Commercial Grease 3 | lithium complex | mineral oil | 289 | NLGI 2 grade, long-life electric motor bearing grease |
| Commercial Grease 4 | polyurea | mineral oil | 557 | NLGI 1.5 grade "sealed for life" electric motor bearing grease |
| Commercial Grease 5 | polyurea | mineral oil | 364 | NLGI 2 grade, premium long-life automotive grease |
| Present Invention (Grease 5, Table 1) | lithium complex with dilithium salicylate | mineral oil | 691 | |

What is claimed is:

1. A grease composition of extended lubricating life and improved high temperature antioxidancy comprising a major amount of a basestock oil of lubricating viscosity and a minor amount of a complex lithium soap thickener, a lithium salt of a $C_3$–$C_{14}$ hydroxy carboxylic acid wherein the OH group is attached to a carbon atom that is not more than 6 carbon atoms removed from the carbon of the carboxyl group and a thiadiazole.

2. The grease of claim 1 wherein the complex lithium soap thickener comprises a combination of a dilithium salt of a $C_2$–$C_{12}$ dicarboxylic acid or a mono- or di-ester of such acids and a lithim salt of $C_{12}$–$C_{24}$ fatty acid or of a 9-, 10-, or 12-hydroxy $C_{12}$–$C_{24}$ fatty acid or esters of such acid.

3. The grease of claim 1 wherein the total amount of the lithium salt components present in the grease ranges from about 2 to about 35 wt % based on finished grease.

4. The grease of claim 1 wherein the amount of lithium salt of $C_3$–$C_{14}$ hydroxy carboxylic acid in the grease is in the range 0.05 to 10 wt % based on finished grease.

5. The grease of claim 1, 2, 3 or 4 wherein the thiadiazole is present in the grease in an amount in the range 0.05 to 5 wt % based on the finished grease.

6. The grease of claim 1, 2, 3 or 4 further containing an additional antioxidant.

7. The grease of claim 5 further containing an additional antioxidant.

8. The grease of claim 6 wherein the additional antioxidant is selected from the group consisting of amine type antioxidants, phenolic type antioxidants and mixtures thereof.

9. The grease of claim 7 wherein the additional antioxidant is selected from the group consisting of amine type antioxidants, phenolic type antioxidants and mixtures thereof.

10. The grease of claim 6 wherein the additoinal antioxidant is present in an mount up to 5 wt %.

11. The grease of claim 7 wherein the additional antioxidant is present in an amount up to 5 wt %.

12. A method for extending the lubricating life and improving the high temperature antioxidancy of a lithium complex grease comprising a major amount of a base stock of lubricating viscosity and a minor amount of a complex lithium soap thickener by adding to the grease a lithium salt of a $C_3$–$C_{14}$ hydroxy carboxylic and wherein the OH group is attached to a carbon atom that is not more than 6 carbon atoms removed from the carbon of the carboxyl group and a thiadiazole.

13. The method of claim 12 wherein the complex lithim soap thickener comprises a combination of a dilithium salt of a $C_2$–$C_{12}$ dicarboxylic acid or a mono- or di-ester of such acids and a lithium salt of $C_{12}$–$C_{24}$ fatty acid or of a 9-, 10-, or 12-hydroxy $C_{12}$–$C_{24}$ fatty acid or esters of such acid.

14. The method of claim 12 wherein the total amount of the lithium salt components present in the grease ranges from about 2 to about 35 wt % based on finished grease.

15. The method of claim 12 wherein the amount of lithium salt of $C_3$–$C_{14}$ hydroxy carboxylic acid in the grease is in the range 0.05 to 10 wt % based on finished grease.

16. The method of claim 12, 13, 14 or 15 wherein the thiadiazole is present in the grease in an amount in the range 0.05 to 5 wt % based on the finished grease.

17. The method of claim 16 further comprising the addition of an additional antioxidant.

18. The method of claim 17 wherein the additional antioxidant is selected from the group consisting of amine type antioxidants, phenolic type antioxidants and mixtures thereof.

19. The method of claim 18 wherein the additional antioxidant is present in an amount up to 5 wt %.

* * * * *